US005713593A

United States Patent [19]

Renaud-Goud et al.

[11] Patent Number: 5,713,593

[45] Date of Patent: Feb. 3, 1998

[54] APPARATUS FOR MODIFYING THE NATURAL PRESSURE DISTRIBUTION OF A SKI ON ITS GLIDING SURFACE AND A SKI EQUIPPED WITH SUCH APPARATUS

[75] Inventors: Gilles Renaud-Goud, Annecy; Pierre Szafranski, Pringy, both of France

[73] Assignee: Salomon S.A., Metz-Tessy, France

[21] Appl. No.: 403,690

[22] PCT Filed: Jun. 21, 1994

[86] PCT No.: PCT/FR94/00746

§ 371 Date: Mar. 13, 1995

§ 102(e) Date: Mar. 13, 1995

[87] PCT Pub. No.: WO95/02437

PCT Pub. Date: Jan. 26, 1995

[30] Foreign Application Priority Data

Jul. 16, 1993 [FR] France ..... 93 08913

[51] Int. Cl.[6] ..... A63C 5/06

[52] U.S. Cl. ..... 280/607; 280/602; 280/617; 280/618

[58] Field of Search ..... 280/607, 602, 280/605, 617, 618, 616, 615

[56] References Cited

U.S. PATENT DOCUMENTS

| | | | |
|---|---|---|---|
| 4,272,099 | 6/1981 | Svoboda et al. | 280/605 |
| 4,294,459 | 10/1981 | Svoboda et al. | 280/605 |
| 5,332,253 | 7/1994 | Couderc et al. | 280/602 |
| 5,397,149 | 3/1995 | Couderc et al. | 280/607 |
| 5,540,458 | 7/1996 | Arduin et al. | 280/602 |
| 5,556,122 | 9/1996 | Arduin et al. | 280/602 |
| 5,558,353 | 9/1996 | Arduin et al. | 280/602 |
| 5,566,966 | 10/1996 | Couderc et al. | 280/602 |

FOREIGN PATENT DOCUMENTS

| | | | |
|---|---|---|---|
| 0530449 | 3/1993 | European Pat. Off. | A63C 5/07 |
| WO93/11838 | 6/1993 | WIPO | A63C 9/00 |

*Primary Examiner*—Eric D. Culbreth
*Attorney, Agent, or Firm*—Greenblum & Bernstein, P.L.C.

[57] ABSTRACT

An interface apparatus for modifying the natural pressure distribution of a ski, particularly an alpine ski, along its gliding surface. The apparatus includes a vertically mobile rear sensor on which the rear end of the boot is supported; a rocking device journalled around a transverse axis, the rocking device having an approximately horizontal arm to which the sensor transmits its vertical movements, and a substantially vertical arm; and a linkage assembly connecting the vertical arm of the rocking device to the base of the front binding element, whereby the forces exerted through the sensor are transmitted to the base of the front binding element. The linkage assembly includes a linkage plate, which is rigid when compressed, that is connected to the base of the front binding element by a journal raised with respect to the upper surface of the ski, the length of the linkage plate being substantially equal to the distance between its connection to the base and the vertical arm of the rocking device, so that, in a lowered position, the linkage plate is in support against the vertical arm of the rocking device and transmits to the base the forces of the sensor.

14 Claims, 8 Drawing Sheets

APPARATUS FOR MODIFYING THE NATURAL PRESSURE DISTRIBUTION OF A SKI ON ITS GLIDING SURFACE AND A SKI EQUIPPED WITH SUCH APPARATUS

BACKGROUND OF THE INVENTION

1. Field of the Invention

The present invention relates to an interface apparatus for modifying the natural pressure distribution of a ski, particularly an alpine ski, on its gliding surface.

The invention also relates to a ski brake that is intended to brake the movement of a ski, especially an alpine ski, in case of the release of the boot that is retained on the ski. The invention also relates to a ski equipped with the aforementioned apparatus or brake.

2. Description of Background and Relevant Information

Skis that are used for alpine skiing are comprised of relatively long beams, on which the boots of the skier are retained by front and rear binding elements. The boots and the binding elements are located approximately in the median zone of the ski. The skis themselves have, at rest, a natural camber, by which the median zone is naturally raised with respect to the front end of the ski, or shovel, and the rear end of the ski, or tail. In addition, the skis have a flexibility, which is due to their internal structure. During skiing, the ski becomes deformed in an elastic manner in response to the different biases to which it is subjected by the skier, but also by the terrain on which it glides.

Known according to the European Patent Application published under the number EP 530 449 in the name of the applicant is an interface apparatus that modifies in a dynamic manner the pressure distribution of the ski on the snow, as a function of the vertical forces that the skier exerts on his skis. This apparatus comprises a vertically mobile sensor that transmits to the base of the front binding element the vertical forces that it captures issuing from the boot. These forces are transmitted by means of a rocking device, and in one of the embodiments, by means of a substantially horizontal linkage plate journalled on one side to the rocking device and on the other side to the base of the binding.

According to an improvement brought about by the applicant, the linkage plate is constructed like a toggle joint that is closed by the boot and that opens on its own when the boot is released. According to a particular embodiment of this improvement, one of the arms of the toggle joint comprises the activation pedal of a ski brake, whose operation thereby becomes connected to the state of the linkage plate. It is the same return energy that raises the linkage plate by breaking the toggle joint, and that returns the brake to an active braking position.

Another improvement of this device consisted of interposing between the rocking device and the base of the binding element one or several pre-stressed springs that absorb the excessive biases that the sensor transmits to the base. In fracturing, the toggle joint eliminates the reaction that this pre-stress induces in the ski as soon as the boot is released from its binding elements that retain it.

This interface apparatus produces good results, but its disadvantage is that the forces transmitted by the rocking device are transmitted by the brake pedal. The conception of this element must therefore take into account the increased stresses that it must transmit. In addition, the different elements of the toggle joint that comprise the linkage plate must be adjusted with great precision so that when the boot is present the forces are correctly transmitted towards the front base.

SUMMARY OF THE INVENTION

One of the objects of the invention is to propose an interface apparatus of the aforementioned type whose construction is simplified.

Another object of the invention is to propose an interface apparatus for which the adjustment tolerances between the different elements are larger.

Another object of the invention is to propose an interface apparatus for which the transmission of the forces between the rocking device and the base is more direct.

Other objects and advantages of the invention will appear in the course of the description to follow, this description being, however, given as a non-limiting example.

According to the present invention, the ski includes an elongated base, two binding elements situated in the median portion of the base to retain the front end and rear end of the boot, each binding element having a base affixed to the ski and a support element which serves as support at one end of the sole of the boot.

The interface apparatus includes:

- a vertically mobile rear sensor, on which the rear end of the boot rests,
- a rocking device journalled about a fixed transverse axis, having an approximately horizontal arm to which the sensor transmits its vertical movements, and a substantially vertical arm,
- a linkage assembly connecting the vertical arm of the rocking device and the base of the front binding element to transmit to it the forces of the sensor.

The linkage assembly includes a linkage plate, rigid when compressed, that is connected to the base of the front binding element by a journal about a transverse axis raised with respect to the upper surface of the ski, wherein the length of the linkage plate is substantially equal to the distance between its journal to the base and the vertical arm of the rocking device, so that in a lowered position, the linkage plate is in support against the vertical arm of the rocking device, and transmits directly to the base the forces of the sensor.

According to another characteristic of the invention, an elastic return device returns the linkage plate to a raised position.

According to another preferred characteristic, the return device is the same as that which returns the braking arms to an active position.

BRIEF DESCRIPTION OF THE DRAWINGS

The invention will be better understood by referring to the description below and to the attached drawings that make up an integral part thereof, wherein.

DETAILED DESCRIPTION OF THE PREFERRED EMBODIMENTS

Figure 1:
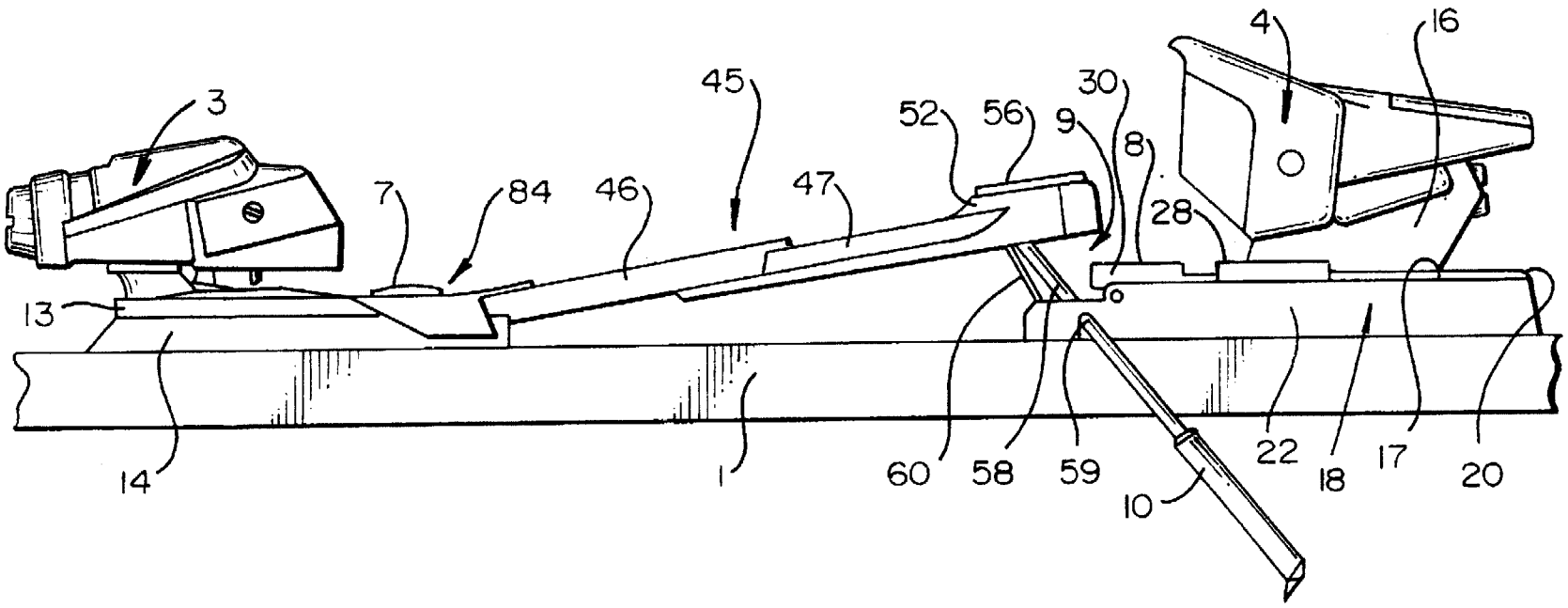
FIG. 1 is a general side elevation view of the interface apparatus assembled to the median portion of a ski.
Figure 2:
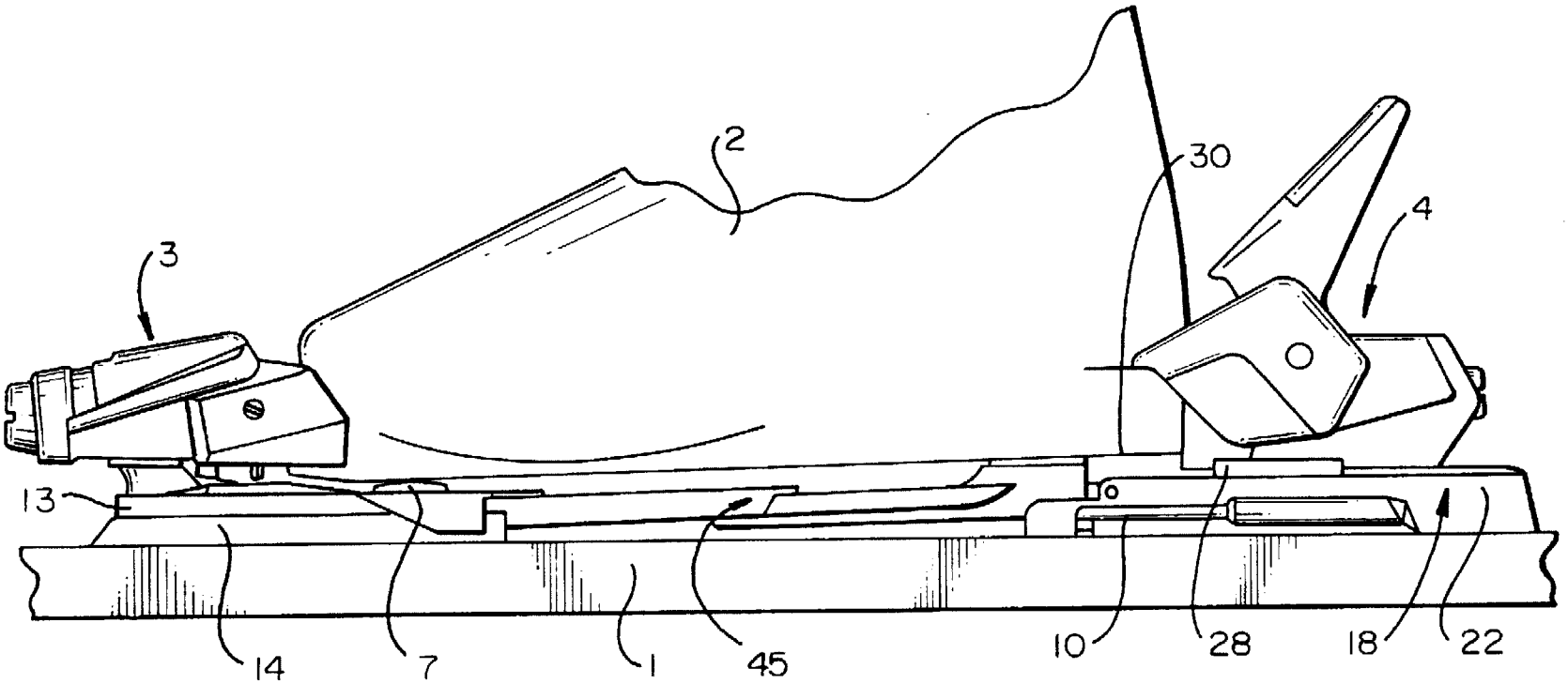
FIG. 2 shows the interface apparatus of FIG. 1 in the presence of the boot.

FIG. 1 represents the median portion of an alpine ski that is equipped with a front binding element 3 and a rear binding element 4.

In a known manner, the base 1 of the ski has an elongated form, with a raised front end or shovel, and a rear end or tail.

The front and rear binding elements are of any appropriate type, and will not be described in detail. They are intended to retain the front and rear ends of a boot and to release the boot when it exerts on one or the other of the elements an excessive force.

In a known manner, in the case of the ski that is represented in FIG. 1, the sole of the boot rests on the base 1 by a front support element 7, and a rear support element 8, that are respectively associated with the front binding element 3 and the rear binding element 4.

The apparatus represented in FIG. 1 additionally comprises, between binding elements 3 and 4, a brake 9, this brake having two lateral braking arms 10 or, more generally, at least one braking arm, only arm 10 being illustrated in FIG. 1.

In referring to FIG. 1, the front binding element 3 has in its lower portion a plate 13, that is affixed to the ski. Preferably, the plate 13 is mounted on a base plate 14, that raises it slightly with respect to the upper surface of the base of the ski. The assembly comprised by the plate 13 and the base plate 14 is affixed by any appropriate means, for example by screws that are not visible in FIG. 3.

The rear binding element 4 has a body 16 that is supported on a mounting plate which, in a known manner, is constituted by a slide 17 along which the body 16 is longitudinally mobile. The slide 17 is connected in a mobile manner to the base 1 by means of a base plate 18 affixed to the ski by any appropriate means, for example screws.

The base plate 18 has two longitudinal and vertical wings 22, whose spacing is slightly greater than the width of the slide 17, in such a way that the slide 17 can be engaged between the two wings. In the side view of FIG. 1, only one wing 22 is visible.

The linkage between the slide 17 and the base plate 18 is accomplished by a pivot connection about an axis parallel to a transverse and horizontal direction located at the rear of the slide 17. In the embodiment illustrated, this axis is imaginary. It is materialized by the rear end portion 20 of slide 17, preferably in the form of a pair of lugs (not shown) that are engaged in corresponding housings of the base plate 18. Naturally, this is not limiting, and any other journal means is suitable, especially a transverse journal axis.

The slide 17 can thus pivot in a vertical and longitudinal plane defined by the longitudinal direction of the ski.

Conversely, it can be noted that the linkage between the slide 17 and the base plate 18 does not permit any movements of the slide 17 other than this movement in the vertical and longitudinal median plane of the ski.

Preferably, this pivoting movement is limited at least upward. The limitation means are represented in the figures in the form of two lugs 28 and 29, that rise from wings 22 of the base plate 18, along the lateral edges of the slide 17. The upper portion of the lugs is folded towards the inside so as to constitute an abutment that limits the upward movement of the slide 17.

Downward, the slide 17 is in support on a block 25 of an elastically compressible material that can possibly have shock absorbing qualities. The block elastically returns the slide 17 towards the lugs 28 and 29. It additionally provides an elastic suspension of the slide.

The slide 17 and the base plate 18 are obtained in any appropriate material that is suited to resist a compression force directed along their length.

The apparatus additionally has a sensor mobile along a vertical direction. In the embodiment shown, the sensor is advantageously comprised of a support plate that is affixed to the front end of the slide 17, by any appropriate means for example, by nesting therewith. The sensor 30 provides a substantially horizontal support surface 8 on which the sole of the boot rests. In addition, it is the slide, by its rotational movement, that assures the guiding of its movement along a substantially vertical direction.

The lower portion of the sensor is in support against the arm 34 of a rocking device 35. The rocking device 35 is journalled in rotation about a transverse pin or axle 36 fixed with respect to the ski. In the embodiment illustrated, the pin 36 is borne by the wings 22 of the base 18. The rocking device 35 has a horizontal arm 34 oriented towards the rear of the pin 36, and an approximately vertical arm 38 oriented towards the bottom with respect to the pin 36. In the zone of the pin 36, the base plate 18 can be internally equipped with a metallic stirrup.

Towards the middle, the vertical arm 38 of the rocking device 35 has a thrustor 40. In the example shown, the thrustor is an element affixed to the arm 38. This is not limiting, and the thrustor 40 could be independent of the rocking device 35, especially suspended from the pin 36. The thrustor 40 provides towards the front an approximately vertical support surface 41 whose movement about the pin 36 responds to the vertical movement of the sensor 30. Preferably the support surface 41 is slightly convex.

The linkage plate 45 additionally connects the rocking device to the base 14 of the front binding element 3. The linkage plate is suited to transmit a force along the longitudinal direction that it defines. The linkage plate is connected in its front portion to the base of the front binding element 3 to enable a rotation about a transverse axis. This connection will be described in detail later.

The plate 45 is shown in two sliding portions 46 and 47, whose assembly is obtained by a screw-nut connection 50 traversing the orifice of the one and a longitudinal slot of the other. This mounting enables adjustment of the length of the linkage plate to the distance between the front and rear binding elements, i.e., to the length of the boot.

The linkage plate 45 has in its rear portion a block 52 providing towards the rear, towards the middle of the width, a support surface generally perpendicular to the longitudinal direction defined by the plate.

The support surface 53 of the block is intended to come into abutting contact with the surface 41 of the thrustor 40, when the linkage plate is pressed towards the ski by the boot, to transmit to the linkage plate 45 the forces captured by the sensor 30 and transmitted by the rocking device 35. Preferably, the support surface 53 is slightly curved in a substantially centered manner on the average position of the rotation axis in front of the plate 45.

During the rotation of the rocking device 35 about pin 36, the surface 41 of the thrustor slides on the support surface 53 of the plate 45, and forces the plate to translate along a longitudinal direction.

The block 52 of the linkage plate additionally has in its upper portion a contact surface 56 for the sole of the boot. When putting on the boot and during skiing, the boot presses on this surface 56.

An elastic return device additionally exerts on the linkage plate an upward return force intended to raise the free end of the plate, i.e., the block 52 in the absence of the boot.

The elastic return device has an arm 58 journalled about an axis 59 borne by the front portion of the base plate 18. The arm 58 pivots about this axis in a forward direction, and it is returned to a raised position on the ski by a spring 60. The upper portion 61 of the arm 58 is engaged in a recess 54 opened downward that the block 52 has in its lower portion. This upper portion presses against the upper wall of this recess, which, under the effect of the spring 60, connects the movement of the arm and that of the linkage plate.

Figure 7:
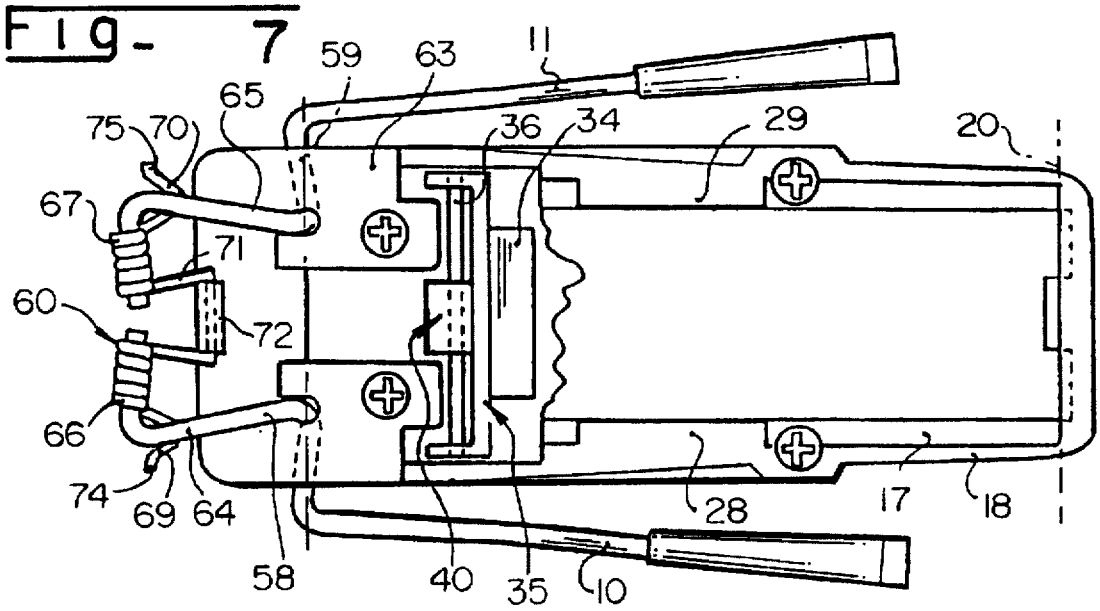
FIG. 7 is a partial top view of the rear portion of the interface apparatus of the invention.
Figure 8:
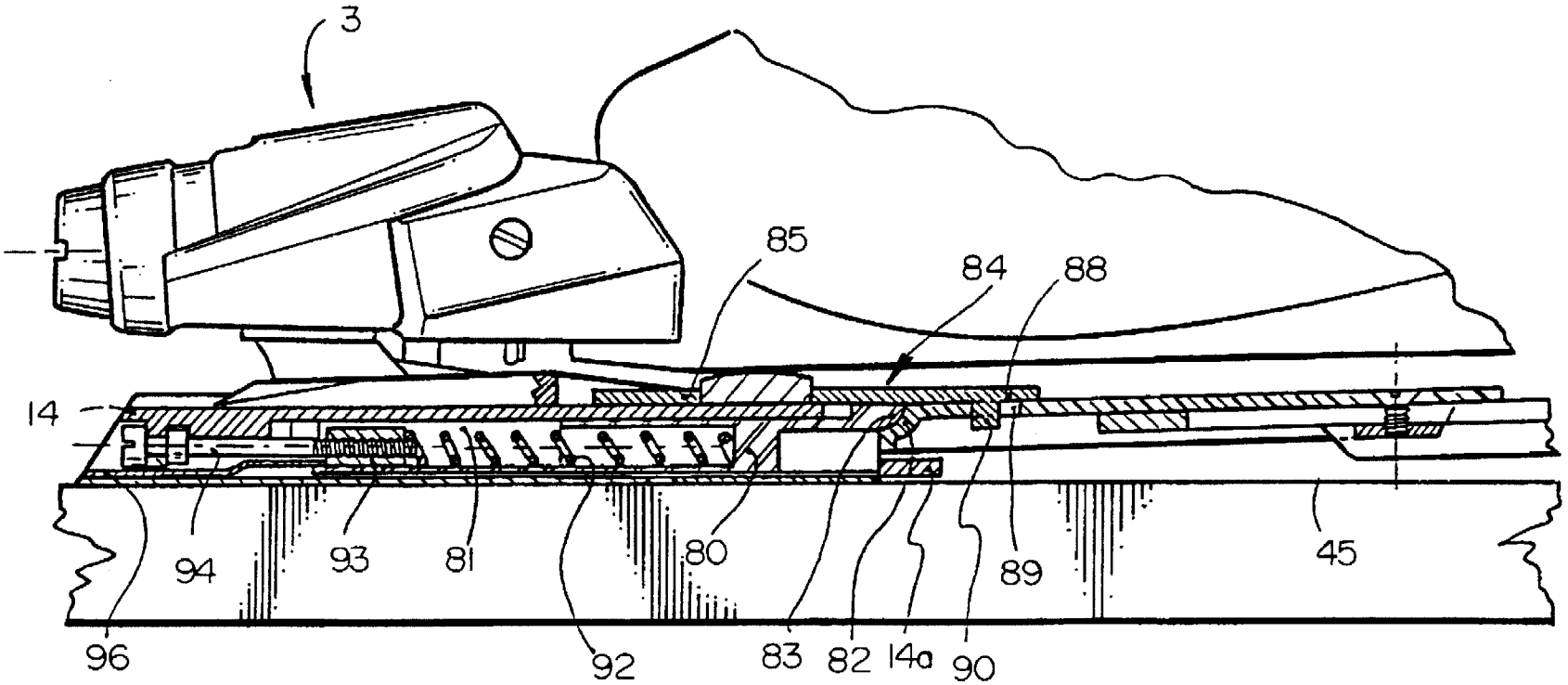
FIG. 8 is a partially sectional side elevation view of the front portion of the interface device.
Figure 9:
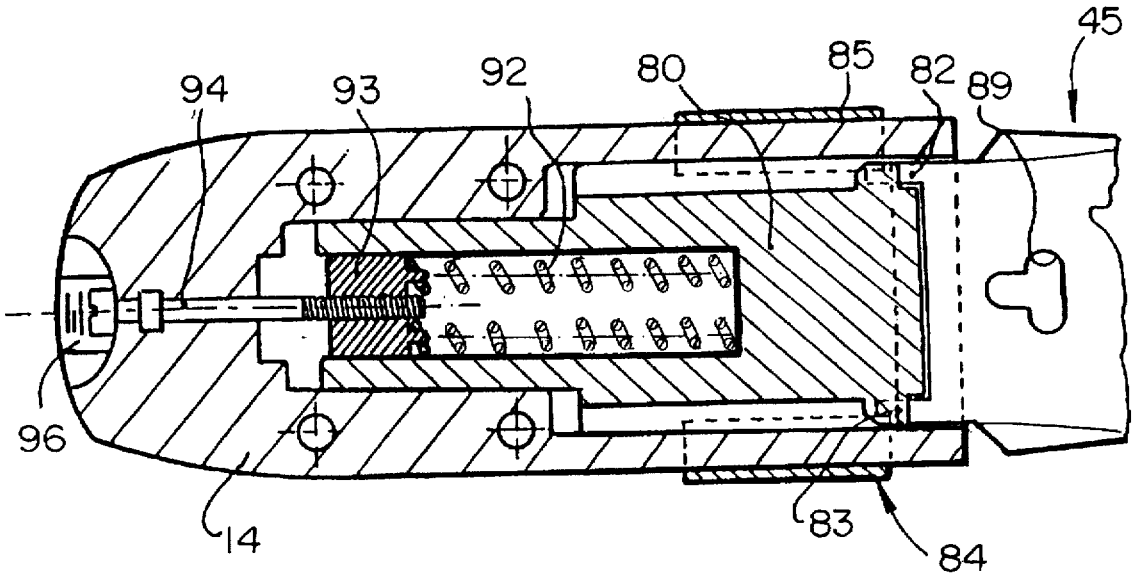
FIG. 9 is a partially sectional top plan view of the apparatus of FIG. 8.
Figure 10:
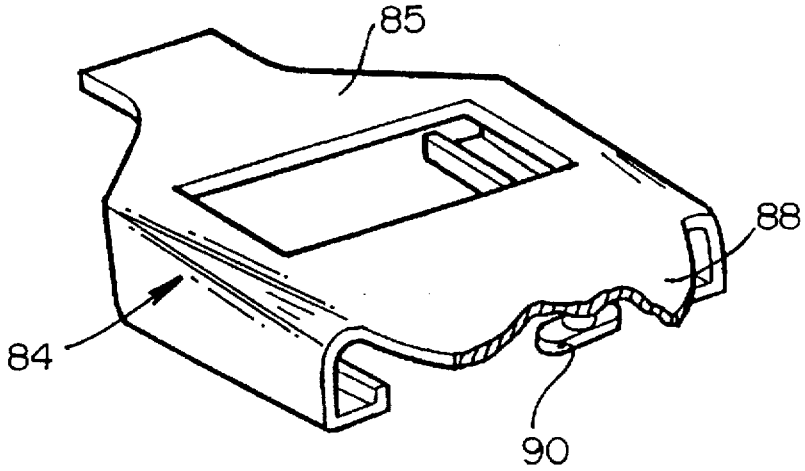
FIG. 10 represents a perspective view of the jumper link between the linkage plate and the base.

According to a preferred embodiment of the invention, the journalled arm 58 is the activator of the brake 9. With reference to FIG. 7, the brake arms 10 are journalled with respect to a bearing 63 located at the front of the base 18 and affixed to the latter. The arms are folded along different successive segments. They have above the bearing 63 two extensions 64 and 65 that comprise the lifting arm 58 previously described. In the area of the beating, the arms have two substantially transverse segments, that comprise their journai axis, but also axis 59 of the lifting arm. The spring 60 is here comprised of two symmetrical windings 66 and 67 nested on the end of the extensions 64 and 65, and immobilized in rotation by end hooks 69, 70. The two windings 66, 67 are joined by a wide loop 71 oriented downward and rearward, with a slant with respect to the horizontal greater than that of the extensions 64 and 65. The base of the loop 71 is in support against the upper surface of the beating 63. In an active braking position, a hook 72 located at the front of the bearing 63 retains the base of the loop 71, so as to maintain the spring 60 under pre-stress.

Advantageously, the spring 60 extends beyond the hooks 69 and 70 by connection studs 74 and 75. These studs are intended to cooperate with grooves 76 cut along the lateral edges of recess 54 of the block 52, to obtain a connection between the linkage plate and its lifting arm.

Figure 3:
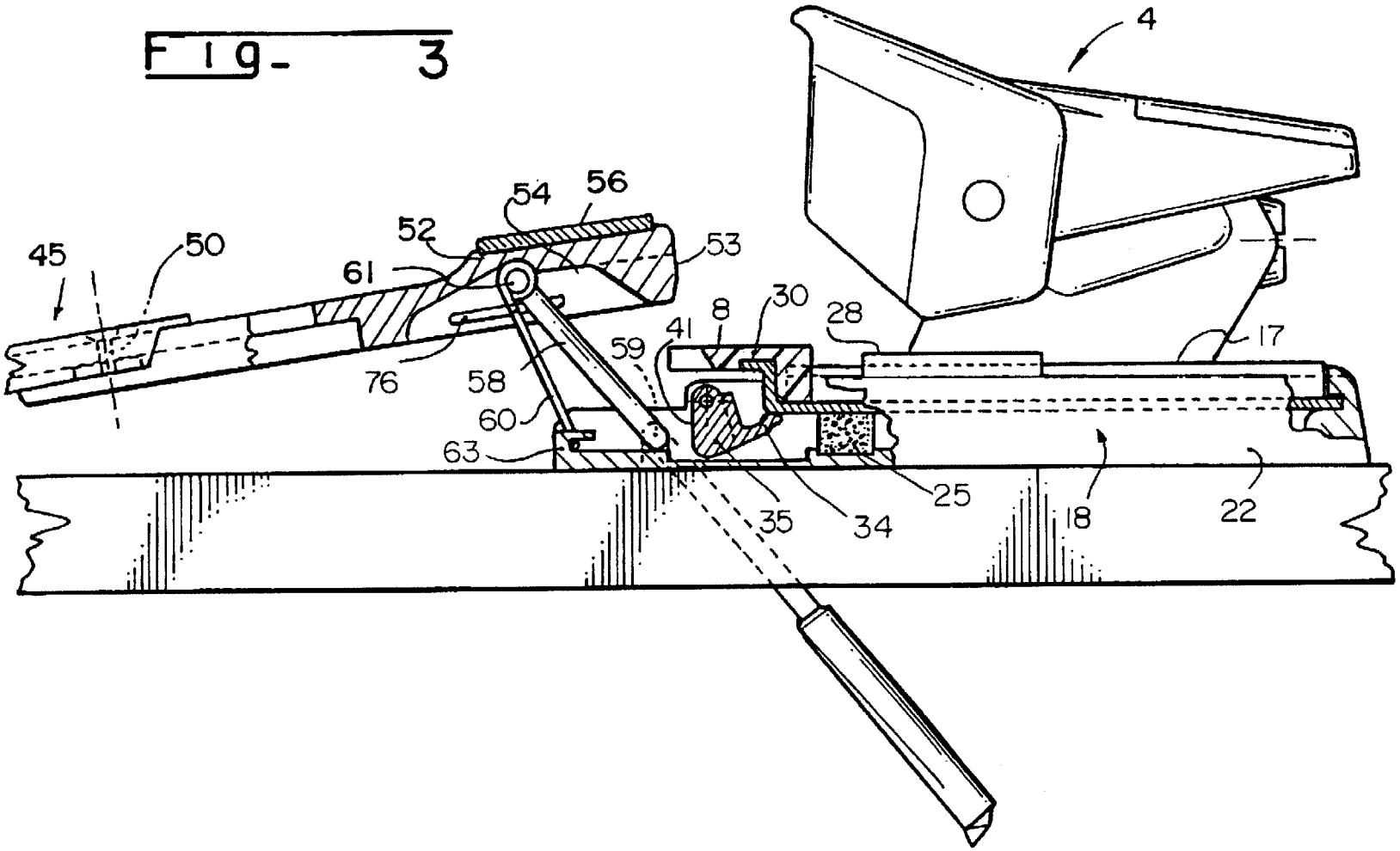
FIG. 3 represents a side and partially sectional elevation view of the rear portion of the interface apparatus.

The operation is as follows. In the absence of the boot, the spring 60 exerts an action on the lifting arm 58 to maintain the linkage plate 45 in a raised position, and the brake in an active braking position with the free ends of the brake arms 10 positioned beneath the lower surface of the ski. FIGS. 1 and 3 show the device in such a situation.

The engagement of the boot in the binding elements forces the linkage plate 45 to lower against the return force of the spring 60, by a support action on the support surface 56 of the block 52. This movement of the plate also causes the rising of the braking arms to an inactive position along the base 18.

The plate 45 lowers until the sole of the user's boot comes into support on the sensor 30. The plate 45 then extends in a substantially horizontal manner beneath the sole of the boot, and the two support surfaces of the block 52 and the sensor 30 are co-extensive. However, it is on the sensor and not the block that the boot is effectively in support in a vertical direction.

In a normal position of the ski, i.e., in the absence of additional stress, the sensor exerts a vertical force on the rocking device that returns it in the linkage plate. The linkage plate transmits this force to the base of the front binding element, and the reaction that the ski has to this normal force maintains the sensor in equilibrium above the ski. All operational backlash is eliminated.

Figure 4:
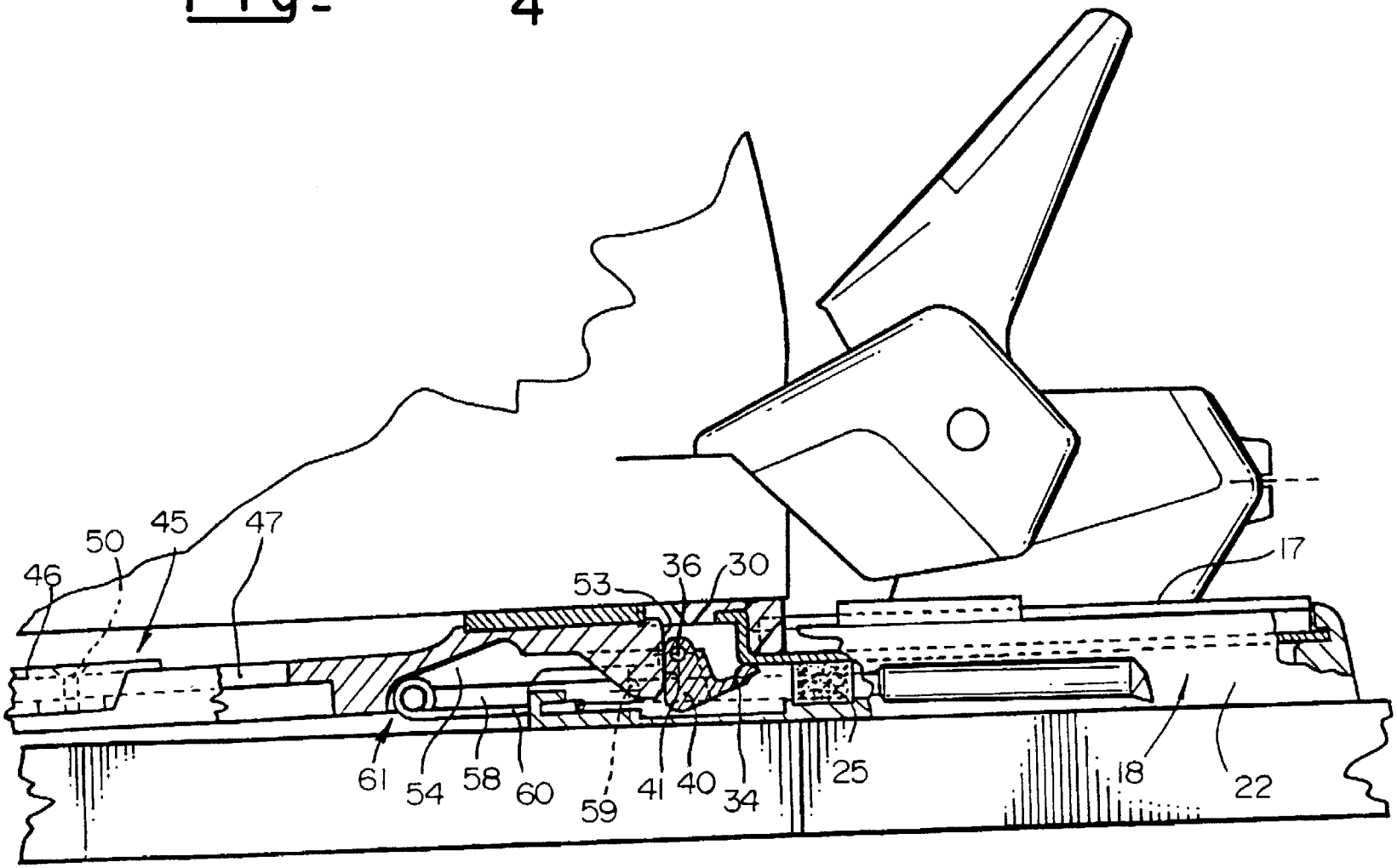
FIG. 4 is a similar view in the presence of the boot.
Figure 5:
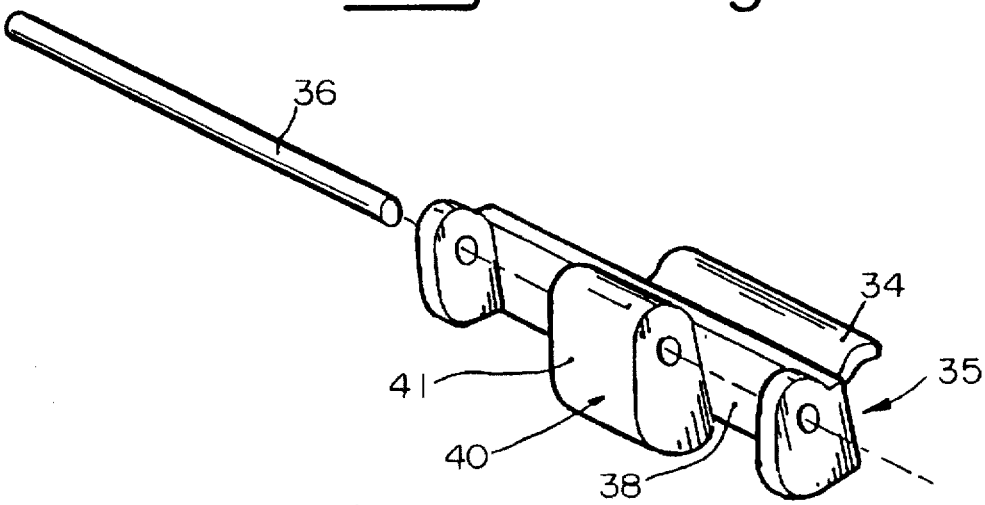
FIG. 5 represents a perspective view of the rocking device of the linkage assembly.

FIG. 4 illustrates this situation of the device.

During an additional force, the sensor lowers, causing rotation of the rocking device 35 and forward translation of the linkage plate 45. This translational movement is transmitted to the ski by means of the base of the front binding element. It is necessary to note that the linkage plate 45 also lowers, on a same amplitude as the sensor 30. It is also necessary to note that the support of the boot on the block 52 only induces minimal friction against the translational movement of the linkage plate, since the boot rests essentially on the sensor 30.

Figure 6:
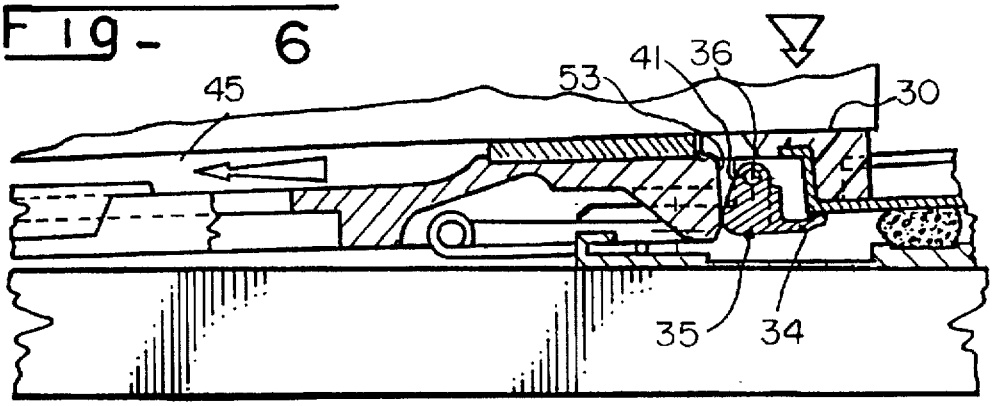
FIG. 6 is a partial side elevation view of the linkage between the sensor and the linkage plate, and illustrates the transmission of a vertically directed force.

FIG. 6 illustrates this situation by a partial view of the linkage between the sensor 30 and the linkage plate 45.

According to a preferred embodiment of the invention, the linkage plate is connected to the base 14 of the front binding element by an assembly that will now be described.

This assembly connects the linkage plate to the base of the front binding element in a zone that is raised with respect to the upper surface of the ski. In this way, the longitudinal forces of the linkage plate are transmitted to the ski in the form of a bending moment that tends to make the shovel of the ski plunge in the direction of the snow. This bending moment is created due to the fact that the length of the linkage plate 45 is adjusted to be slightly greater than the distance between the its connection to base 14 of the front binding element and the forwardmost surface of the vertical arm 38 of the rocking device 35, i.e., the front surface of the thruster 40 in the illustrated embodiment.

In addition, preferably, this assembly includes an elastic element, that functions to reduce the excessive forces that are transmitted to the base.

In referring to the embodiment illustrated, the linkage assembly comprises a slide 80 that is guided for a translational movement along a longitudinal direction in a housing 81 located in the lower portion of the base 14. The linkage plate is connected to the rear portion of this slide 80 by two assemblies having complementary raised and hollow forms 82 and 83, that comprise a false journal axis oriented along a transverse direction. These forms assure a rotation of the linkage plate with respect to the slide between its lowered position for skiing and its raised position. These forms also assure a transmission of the longitudinal forces between the linkage plate and the slide in a longitudinal direction. They are substantially raised with respect to the upper surface of the ski, so as to form a lever arm for the forces that they transmit.

Preferably, a jumper link made of a flexible material 84 retains the linkage plate 45 connected to the slide 80. The jumper link 84 has a front portion 85 that encloses the base 14 of the front element, more exactly in the area of the front support element. The front portion 85 immobilizes the jumper link with respect to the base in a longitudinal direction. In the embodiment illustrated, the front portion of the jumper link has a recess that is nested on the support element 7. The support element 7 then projects through this recess. This is not limiting, and according to a variation, the front portion of the jumper link could itself comprise the support of the boot, i.e., have at its upper surface a plate of anti-friction material or other appropriate means.

Towards the rear, the jumper link 84 has a flexible tongue 88 that covers the journal between the linkage plate 45 and the slide 80, and the front portion of the linkage plate. The tongue is assembled to the linkage plate for example, by a pin 90 located at its lower surface, which is engaged in an orifice 89 in the form of an oblong opening of the linkage plate 45. The tongue retains the linkage plate in support against the slide, and also enables the rotational movement of the linkage plate about forms 82 and 83. In operation, the translational movement of the linkage plate 45 translates into a relative movement between the linkage plate and the jumper link 84 in the area of the tongue 88, especially the pin 90 and the oblong opening 89.

The assembly and separation of the linkage plate and the slide is done by connection and disconnection of the jumper link to the linkage plate.

Under the force of the linkage plate 45, the slide 80 is displaced forward against the return force of the spring, or of a set of springs 92. Towards the rear, the movement of the slide 80 is limited by an abutment **14*a* affixed to the base 14. In the embodiment illustrated, the abutment 14*a*** is located at the rear of the base, and it cooperates with the rear end of the slide.

The springs 92 are in front support against a mobile carriage 93. A screw 94 whose head is immobilized with respect to the base 14 enables displacement of the carriage 93 towards the front or rear, and thus adjustment of the initial compression of the springs 92.

The head of the screw 94 is accessible at the front of the interface device.

The initial compression of the springs defines the pre-stress applied to the slide 80, i.e., the minimal force that the linkage plate must transmit to the slide to cause its displacement. On this side of this force, the slide acts like an element affixed to the base, and the forces are integrally transmitted to the ski in the form of a bending moment. For forces that exceed the pre-stress of the springs 92, the slide is displaced forward. A portion of the forces is transmitted, as previously, to the ski. Another portion is absorbed by the springs. However, the essential effect of the slide and springs is to limit the amplitude of the forces that could become substantially high in the case of increased forces exerted by the skier, or strong bendings of the ski due to the contours of the terrain.

Before the boot is placed into the apparatus, the linkage plate is maintained in a raised position by the arm 58. The length of the linkage plate 45 is preferably slightly greater than the distance between the journal 83 and the vertical arm of the rocking device. When the boot is placed into the apparatus, this induces a slight additional compression of the springs 92. On the one hand, this eliminates operation backlash. Moreover, this induces in the linkage plate an initial compression stress to which is added in turn the stresses caused by the forces that the skier induces by his weight and his support on the ski.

Upon release of the boot, the arm 58 and the spring 60 return the linkage plate to a raised position. The prior pre-stress disappears, which avoids its exertion in a permanent manner in the linkage plate and by reaction in the ski.

According to a preferred embodiment, a tongue 96 affixed to the carriage is visible at the front of the apparatus, in the vicinity of the head of the screw. This tongue shows the position of the carriage, and thus the intensity of the pre-stress induced by the springs 92.

The intensity of the pre-stress defines the reactivity of the interface apparatus in response to the vertical forces of the boot. Good results were obtained with a pre-stress varying from 30 to 100 daNewtons associated with a super-elevation in the order of 15 mm of the journal of the linkage plate to the base. These values, however, are not limiting as far as the invention is concerned.

Figure 11:
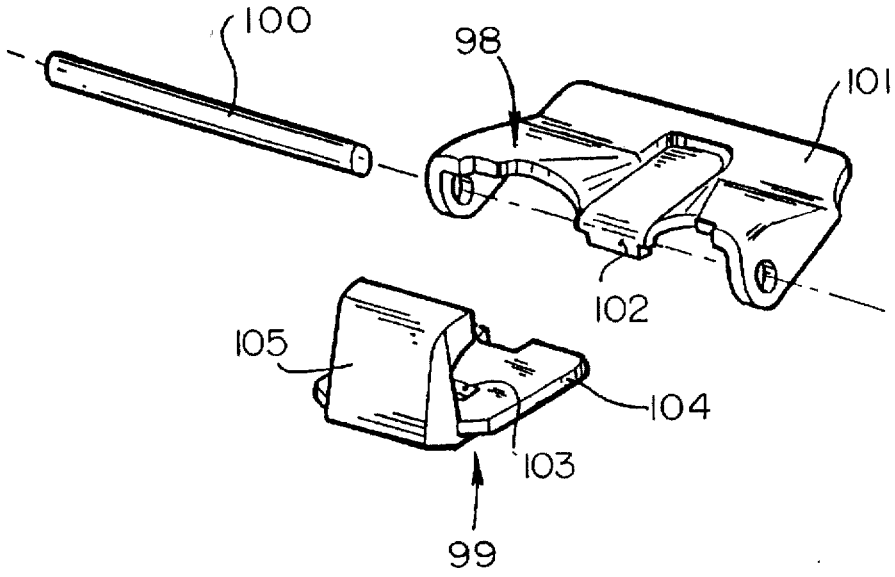
FIG. 11 represents in perspective the linkage rocking device, according to a variation of the invention.
Figure 12:
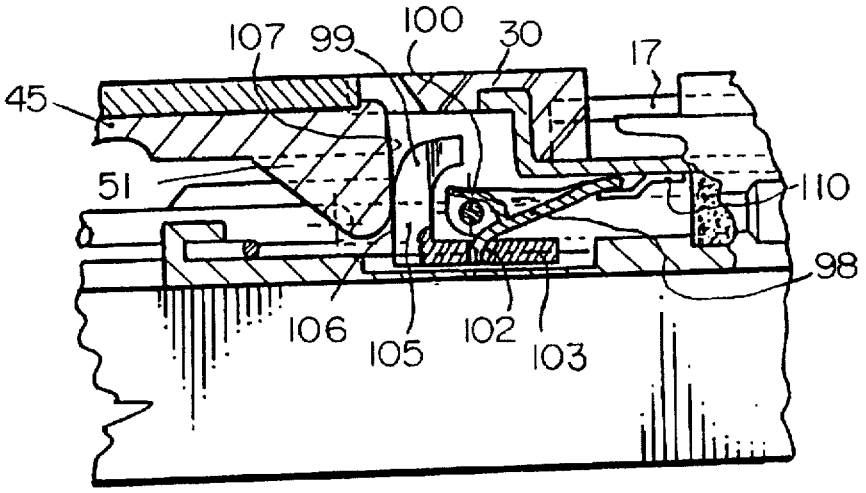
FIG. 12 is a side sectional elevation view that shows the linkage between sensor and the plate according to the variation of FIG. 11.

FIG. 11 is directed to a variation according to which the rocking device 35 is replaced by a rocking device 98 having a reduced height, which drives away a thrustor 99, guided in translation along the upper surface of the ski.

The rocking device 98 is journalled about an pin 100 borne like pin 36 by the base 18. However, the pin 100 occupies a lower position with respect to the upper surface of the ski than does pin 36. The reaction to the forward thrust of the plate passes by the pin. Because of its position near the neutral fiber of the ski, this reaction exerts on the rear end of the ski a weaker bending moment than in the previous case.

The rocking device 98 has, like rocking device 35, an approximately horizontal arm 101 on which the front end of the slide 17 takes support, with the sensor 30.

Towards the bottom, the rocking device 98 has a tooth 102 that is engaged in the orifice 103 of the thrustor 99.

The thrustor 99 has, seen from the side, the form of an "L". Its horizontal portion 104 that has the orifice 103 is translationally guided along the upper surface of the ski, or a sliding surface, for example of the base plate 18 that extends parallel to the upper surface of the ski.

The linkage between the rocking device and the thrustor is assured by the engagement of the tooth 102 of the rocking device in the orifice 103 of this portion of the thrustor. This linkage is also localized very near the upper surface of the ski, thus very near its neutral fiber.

The vertical portion 105 of the thrustor has on the front a support surface 106 on which the support surface 107 of the block 52 of the plate 45 bears.

Advantageously, the support surface 106 is curved upward to facilitate the placement of the surface 107 during engagement of the boot.

Preferably, the slide 17 has at its lower surface a tongue 110 provided to pinch the arm 101 in cooperation with the bottom of the slide 17, so as to assure a reversible linkage between the slide and the rocking device.

This embodiment operates in a manner similar to that previously described.

In case of additional force, the sensor lowers. This movement causes the rotation of the rocking device 98 which translationally drives the thrustor 99 along the ski. The thrustor transmits its longitudinal thrust to the plate 45 by its support against the block 53.

With this variation, the transmission of the movement of the rocking device to the plate implements the thrustor 99. In other words, the plate 45 is biased by the thrustor 99 which is moved like it in a translational manner. The efficiency of the linkage is improved with respect to the linkage by the rocking device 35.

The present description is given only as an example, and other embodiments of the invention could be adopted without at all leaving the scope of the invention.

We claim:

1. An apparatus adapted to be positioned between a boot and a ski for modifying the natural pressure distribution of the ski over a gliding surface of the ski, the ski being equipped with a front binding element and a rear binding element for retaining a boot upon the ski, said apparatus comprising:

a front base adapted to be affixed to the ski;

a rear base adapted to be affixed to the ski;

a sensor mounted with respect to said rear base for movement in a vertical plane for capturing vertical forces of a rear portion of the sole of the boot;

a rocking device mounted with respect to said rear base for pivotal movement about a transverse axis, said rocking device having a substantially horizontal arm and a substantially vertical arm, said sensor being connected to transmit vertical movements to said substantially horizontal arm of said rocking device to move said rocking device about said transverse axis; and a linkage assembly extending between said substantially vertical arm of said rocking device and said front base for transmitting forces exerted by said sensor to said front base, said linkage assembly comprising a longitudinally rigid linkage plate having a front end connected to said front base at a front connection raised with respect to an upper surface of the ski for pivotal movement of said linkage plate about a horizontal axis between a lowered position and a raised position, said linkage plate having a rear end in abutting support against said substantially vertical arm of said rocking device in said lowered position.

2. An apparatus according to claim 1, further comprising:

an elastic return device affixed to said linkage plate, said elastic return device being positioned to exert an upwardly directed elastic return force to said linkage plate to move said linkage plate upwardly in the absence of the boot from the apparatus out of said abutting support against said rocking device.

3. An apparatus according to claim 2, wherein:

said elastic return device comprises:

at least one lifting arm, said lifting arm being supported by said rear base and having one end mounted for movement about a transverse axis and another end in support against said linkage plate; and a return spring positioned for biasing said lifting arm to a raised position, corresponding to said raised position of said linkage plate.

4. An apparatus according to claim 3, wherein:

said linkage plate includes a lower surface, said lower surface including a recess, and said lifting arm is housed in said recess in said lowered position of said linkage plate.

5. An apparatus according to claim 3, further comprising:

a ski brake having a pair of laterally spaced braking arms, each braking arm having free ends;

said at least one lifting arm being connected to a respective one of said braking arms and constituting an activator of said ski brake for moving said free ends of said braking arms between an active braking position beneath a lower surface of the ski and an inactive position raised therefrom.

6. An apparatus according to claim 5, wherein:

said return spring constitutes a return spring positioned for moving said lifting arm to said raised position of said lifting arm and for moving said free ends of said brake arms to said active position; and said return spring has connecting studs in engagement with said rear end of said linkage plate.

7. An apparatus according to claim 1, wherein:

said rear base comprises a rear base plate adapted to support the rear binding element;

a mounting plate is mounted for pivotal movement about a transverse axis located at a rear of said rear base plate; and said sensor constitutes a front end of said mounting plate.

8. An apparatus according to claim 1, wherein:

said rear end of said linkage plate includes a support surface adapted to support a portion of the sole of the boot while the boot is engaged in the rear binding element.

9. An apparatus according to claim 1, wherein:

said linkage plate has a length slightly greater than a distance between said front connection and said substantially vertical arm of said rocking device.

10. An apparatus according to claim 1, wherein:

said linkage plate includes a front portion and a rear portion, said front portion and rear portion being slidably connected, and an adjustable connector for enabling said front and rear portions to be selectively slidably moved to adjust a length of said linkage plate and fixed at said length.

11. An apparatus according to claim 1, wherein:

said front connection between the linkage plate and the front base is a journal connection.

12. An apparatus adapted to be positioned between a boot and a ski for modifying the natural pressure distribution of the ski over a gliding surface of the ski, said apparatus comprising:

a front binding element, including a front base adapted to be affixed to the ski;

a rear binding element, including a rear base adapted to be affixed to the ski;

a sensor mounted with respect to said rear base for movement in a vertical plane for capturing vertical forces of a rear portion of the sole of the boot;

a rocking device mounted with respect to said rear base for pivotal movement about a transverse axis, said rocking device having a substantially horizontal arm and a substantially vertical arm, said sensor being connected to transmit vertical movements to said substantially horizontal arm of said rocking device to move said rocking device about said transverse axis; and a linkage assembly extending between said substantially vertical arm of said rocking device and said front base for transmitting forces exerted by said sensor to said front base, said linkage assembly comprising a longitudinally rigid linkage plate having a front end connected to said front base at a front connection raised with respect to an upper surface of the ski for pivotal movement of said linkage plate about a horizontal axis between a lowered position and a raised position, said linkage plate having a rear end in abutting support against said substantially vertical arm of said rocking device in said lowered position.

13. An apparatus according to claim 12 in combination with the ski.

14. An apparatus according to claim 12 in combination with the ski, said ski being an alpine ski.

* * * * *